US007357131B2

(12) United States Patent
Moreth, III et al.

(10) Patent No.: US 7,357,131 B2
(45) Date of Patent: Apr. 15, 2008

(54) AIR CURTAIN DOOR SYSTEM FOR AN OVEN

(76) Inventors: R. Edward Moreth, III, 3000 Seaview Pl., Fort Lauderdale, FL (US) 33305; R. Edward Moreth, 3000 Seaview Pl., Fort Lauderdale, FL (US) 33305

( * ) Notice: Subject to any disclaimer, the term of this patent is extended or adjusted under 35 U.S.C. 154(b) by 230 days.

(21) Appl. No.: 11/061,491

(22) Filed: Feb. 17, 2005

(65) Prior Publication Data

US 2005/0183715 A1 Aug. 25, 2005

Related U.S. Application Data

(60) Provisional application No. 60/545,811, filed on Feb. 19, 2004.

(51) Int. Cl.
*F24C 15/04* (2006.01)
*F24F 9/00* (2006.01)

(52) U.S. Cl. ..... 126/198; 126/193; 454/188

(58) Field of Classification Search ..... 126/198, 126/193; 454/188, 193
See application file for complete search history.

(56) References Cited

U.S. PATENT DOCUMENTS 3,889,100 A * 6/1975 Dills ..... 219/393
5,387,258 A * 2/1995 Puricelli ..... 126/21 A
6,146,677 A 11/2000 Moreth
6,250,210 B1 6/2001 Moreth
6,848,441 B2 * 2/2005 Bachinski et al. ..... 126/512

* cited by examiner

*Primary Examiner*—Alfred Basichas

(57) ABSTRACT

An air curtain door system for inhibiting heat and exhaust exiting from an access opening of an oven includes a door panel which has an access opening and a mantle attached to a bottom end of the access opening, the mantle having an air outlet slot extending horizontally along the access opening; an air inlet opening near a lower end of the door panel; a hollow chamber within the door panel disposed from the mantle to near the lower end of the door panel; an air supply means for providing air supply to the hollow chamber through the air inlet opening; and an exhaust venting assembly adjacent to an upper end of the door panel, for pulling air exiting from the air outlet slot into the exhaust venting assembly, thereby forming an air curtain covering the access opening at the interior side of the door panel.

16 Claims, 7 Drawing Sheets

AIR CURTAIN DOOR SYSTEM FOR AN OVEN

CROSS REFERENCE TO RELATED APPLICATIONS

This application claims the benefit under 35 USC 119 (e) of the provisional patent application Ser. No. 60/545,811, filed on Feb. 19, 2004, which is herein incorporated by reference in its entirety.

FIELD OF THE INVENTION

The present invention relates to an air curtain door system for an oven. More specifically, it relates to a door system which has a door panel having a access opening and an air curtain produced by the system at the interior of the door panel to prevent hot air and smoke from releasing through the opening.

BACKGROUND OF THE INVENTION

Various cooking ovens have a permanent front access opening for frequent input and retrieval of food items from the access opening. The open view of cooking in a restaurant also gains the customers' appreciation of the genuine food preparation process. However, the heat and exhaust exiting from the access opening are undesirable, which elevate surrounding environment temperature and release smoke, dust and smell into the surrounding area. Consequently, it is required in the United States that a hood has to be installed in front of the access opening of an oven to vent out the exhaust exiting from the access opening.

Therefore, it is desirable to have an oven which has a structure or a mechanism to inhibit the heat and exhaust from exiting from the access opening.

SUMMARY OF THE INVENTION

Figure 1:
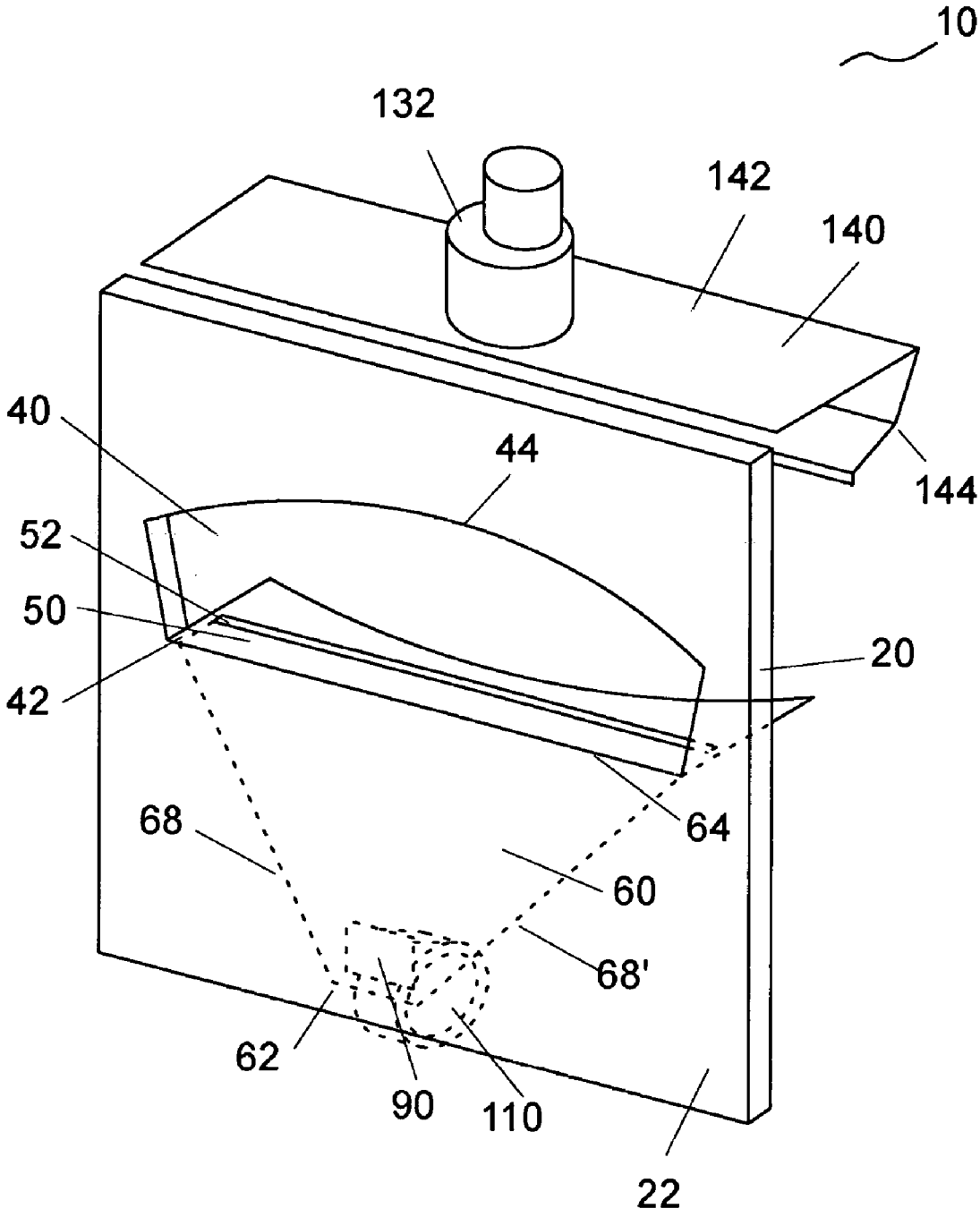
FIG. 1 is a front view of the air curtain door system in one embodiment of the present invention.

In one embodiment, the present invention is directed to an air curtain door system for an oven. The air curtain door system comprises (a) a door panel having an interior panel and an exterior panel; the door panel includes an access opening at an upper portion thereof; a mantle attached to a bottom end of the access opening, the mantle extending horizontally along a width of the access opening and extending toward an interior side of the door panel beyond the interior panel; the mantle having an air outlet slot positioned at the interior side of, and adjacent to, the door panel, the air outlet slot extending horizontally along the access opening; an air inlet opening on the interior panel near a lower end of the door panel; a hollow chamber between the interior and exterior panels disposed from the mantle to near the lower end of the door panel; a bottom portion of the hollow chamber connecting to the air inlet opening; and a top portion of the hollow chamber having an air outlet section underneath the mantle; and the air outlet section being formed by extruding of a top portion of the interior panel toward the interior side of the door panel and connecting to a bottom side of the mantle at an interior side of the air outlet slot, and the air outlet section extending horizontally along the mantle; thereby the air outlet slot being an outlet of the hollow chamber; (b) an air supply means located near the lower end of the door panel, and interfacing with the air inlet opening for providing air supply to the hollow chamber through the air inlet opening; and (c) an exhaust venting assembly located at the interior side of, and adjacent to an upper end of, the door panel, for pulling air exiting from the air outlet slot of the mantle into the exhaust venting assembly, thereby forming an air curtain covering the access opening at the interior side of the door panel.

In a further embodiment, the present invention is directed to an oven which includes the air curtain door system described above.

In another embodiment, the present invention is directed to a method of inhibiting heat and exhaust in an oven from exiting from an access opening thereof. The method includes installing the instant door panel described above to the front of a heating chamber; providing an air supply means near the lower end of the door panel, and interfacing the air supply means with the air inlet opening on the door panel to provide air supply into a hollow chamber with the door panel; and providing an exhaust venting assembly at the interior side of the door panel, adjacent to an upper end of the door panel, wherein the exhaust venting assembly pulls air exiting from the air outlet slot of the mantle into the exhaust venting assembly, and forms an air curtain covering the access opening at the interior side of the door panel; wherein the air curtain inhibits heat and exhaust inside the heating chamber from exiting from the access opening.

The air curtain door system of the present invention can be used for other ovens and heating devices, where inhibition of heat and exhaust inside the heating chamber from exiting from the access opening is desired.

DETAIL DESCRIPTION OF THE INVENTION

Figure 2:
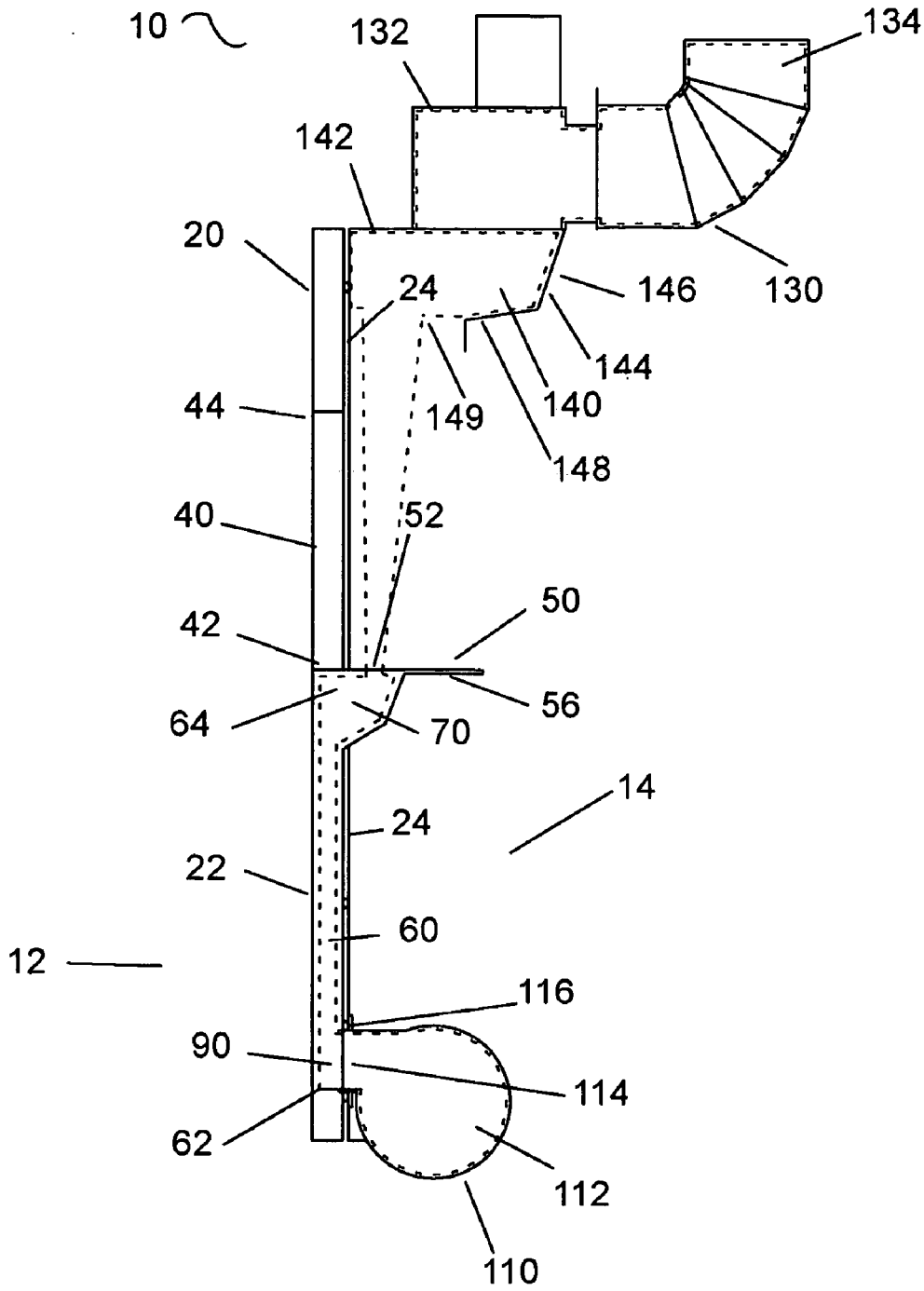
FIG. 2 is a side sectional view of the air curtain door system shown in FIG. 1.
Figure 3:
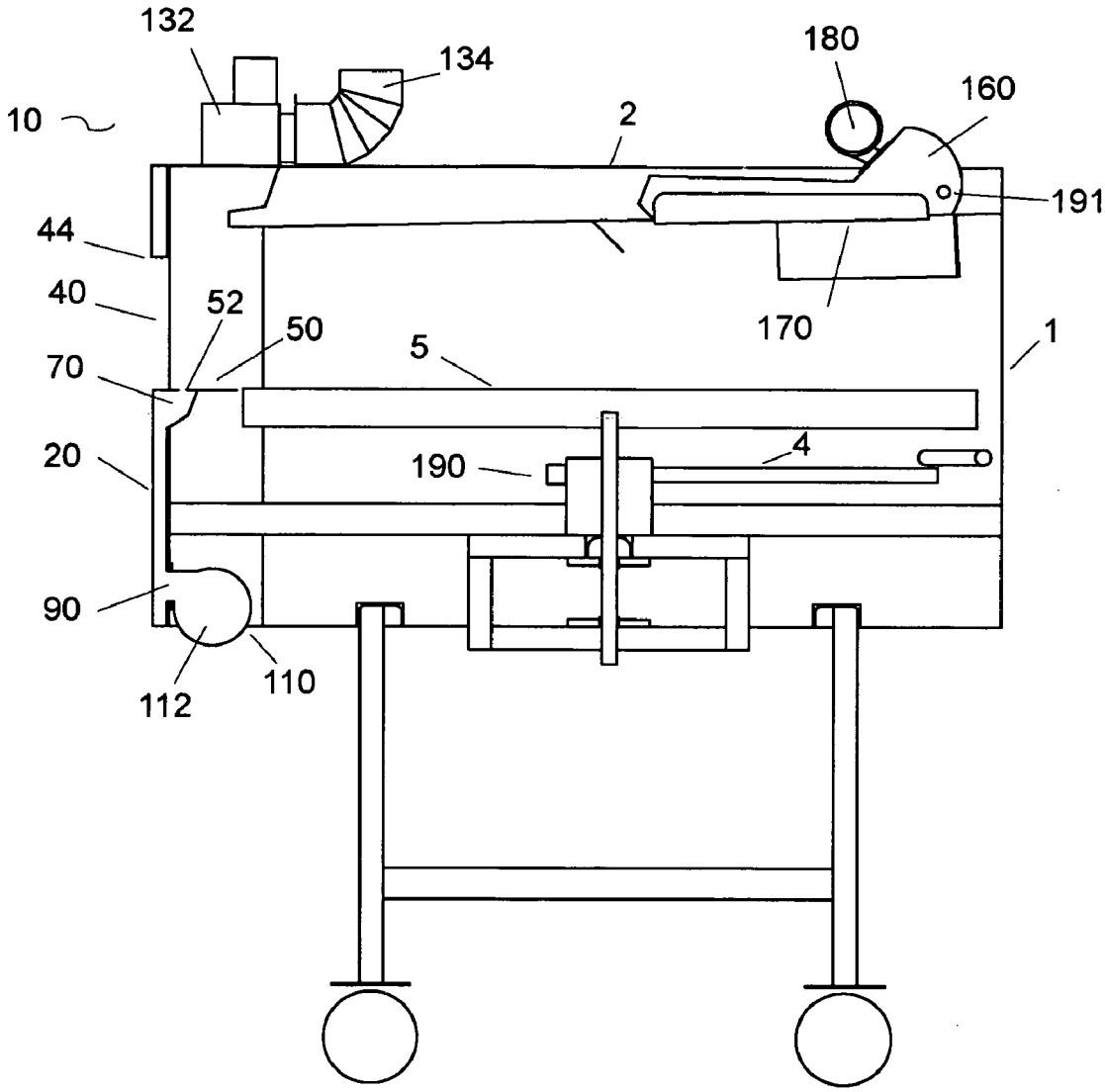
FIG. 3 is a schematic side sectional view of the air curtain door system installed to the front portion of a cooking oven.

In one embodiment, the present invention provides an air curtain door system for an oven. Referring to FIGS. 1 to 3, the air curtain door system 10 has a door panel 20, an air supply means 110 located at the interior side 14 near the lower end of door panel 20; and an exhaust venting assembly 130 located at a top end of interior side 14 of door panel 20.

Door panel 20 has an exterior panel 22 and an interior panel 24, an access opening 40 at the upper middle portion thereof, and a mantle 50 attached to the bottom end 42 of access opening 40. Mantle 50 extends horizontally along the entire width of access opening 40 and extends toward the interior side 14 and extrudes beyond interior panel 24. Mantle 50 has an air outlet slot 52 which extends horizontally near the entire width of mantle 50 and is positioned at the interior side 14 and adjacent to the vertical plane of interior panel 24. In one embodiment, door panel 20 has a width of 30 inches and thickness of 1 inch, access opening 40 and mantle 50 have a width of 26 inches, air outlet slot 52 has a length of 25 inches (aligned along the width of access opening 40), and a width of 0.5 inch. In general, the width of air outlet slot 52 can be in a range from about 0.25 inch to about 1 inch.

In one embodiment, the vertical planes of exterior panel 22 and interior panel 24 are in parallel to each other. There is an air inlet opening 90 on interior panel 24 near the lower end of door panel 20. Door panel 20 has a hollow chamber 60 between exterior panel 22 and interior panel 24, disposed from mantle 50 to near the lower end of door panel 20. The hollow chamber 60 connects to air inlet opening 90 near its bottom end 62 and has its upper end 64 ended by mantle 50. At the top portion of hollow chamber 60 there is an air outlet section 70 underneath mantle 50, which is formed by extruding of interior panel 24 from its vertical plane toward the interior side 14 and connecting to the bottom side 56 of mantle 50 at the interior side of air outlet slot 52 to form an enclosure. Air outlet section 70 extends horizontally along mantle 50 and has air outlet slot 52 as the air outlet of hollow chamber 60. The connection interface between mantle 50 and interior panel 24 can be welded together, or by other suitable means, to form an air-tight seal.

In a preferred embodiment as shown in FIG. 1, hollow chamber 60 has a V-shape like geometry, with two opposing side walls 68 and 68' extending outwardly in the upward direction. At its upper end, the width of hollow chamber 60 is substantially equivalent to a length of air outlet slot 52. The areas outside the hollow chamber between exterior panel 22 and interior panel 24 are filled with a heat-resistant and thermal isolation material. Air inlet opening 90 is positioned near bottom end 62 about the center along a horizontal axis of hollow chamber 60, as shown in FIG. 1. Alternatively, it can also be off center and located toward one side, as shown in FIG. 4.

Figure 4:
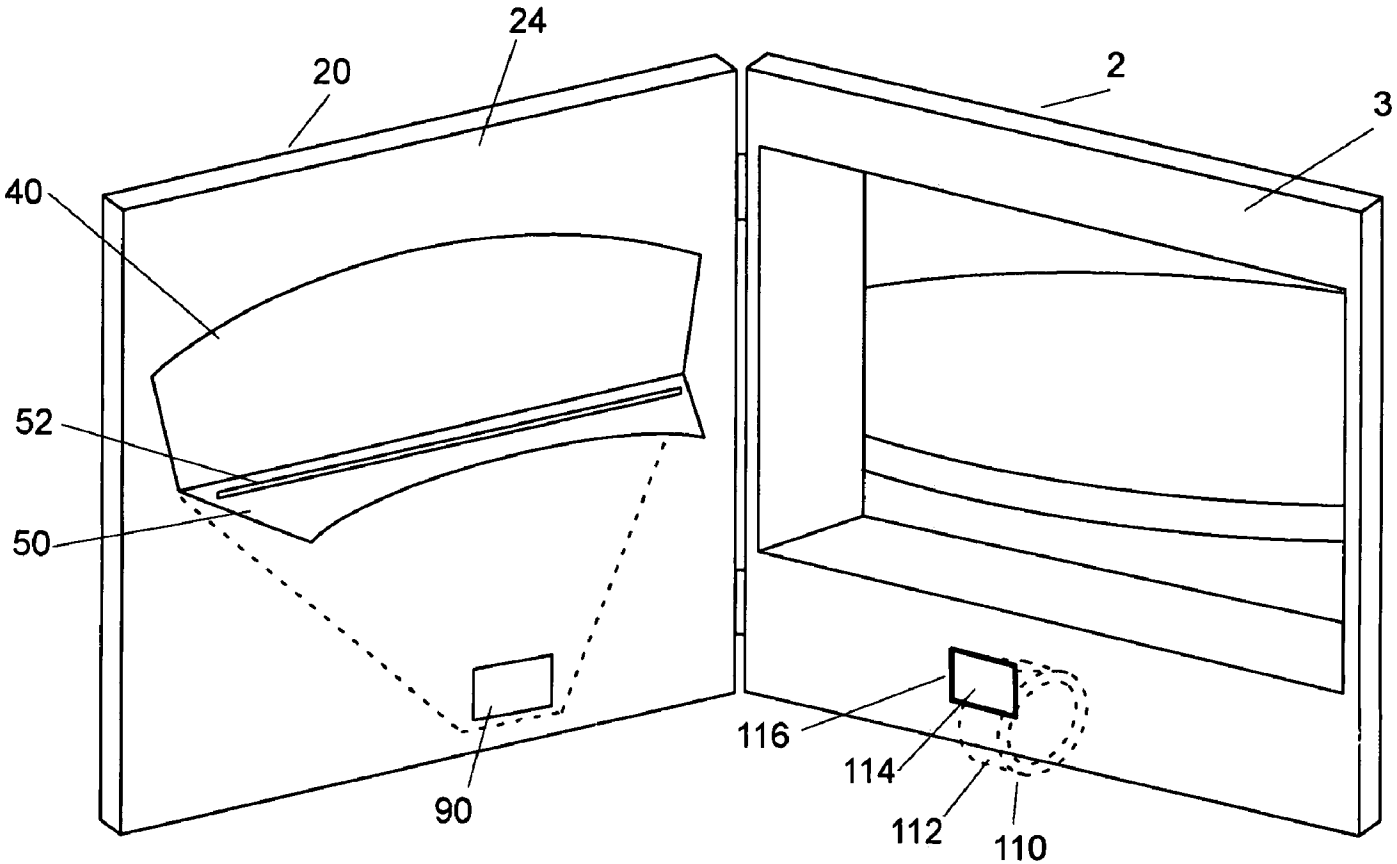
FIG. 4 is a prospective view of the door panel from the interior side when the door panel is in an open position, and the air supply means installed underneath the oven.

The air supply means 110 includes an air blower 112 for providing air supply through an air supply outlet 114 of air supply means 110, as shown in FIG. 4. Preferably, air supply outlet 114 has a complementary structure to that of air inlet opening 90, and can further have an air outlet sealing means 116 attached around air supply outlet 114. The air outlet sealing means 116 faces interior panel 24 for providing an air seal at the interface between air inlet opening 90 and air supply means 110. Alternatively, the sealing means can be attached to interior panel 24 around air inlet opening 90 for providing an air seal at the interface between air inlet opening 90 and air supply means 110. In one embodiment, the air blower is a 96 CFM blower. As shown in FIG. 4, the air blower can be attached to the bottom of the front portion 3 of a cooking oven 2 and provides air supply to hollow chamber 60 through air inlet opening 90.

As shown in FIG. 2, exhaust venting assembly 130 includes an exhaust blower 132, an exhaust duct 134 and an exhaust collector 140. Exhaust collector 140 has a closed top section 142, a closed back section 144, and an open section 149 downwardly facing air outlet slot 52. As shown in FIG. 1, exhaust collector 140 extends horizontally along the upper end of door panel 20 to near the width of door panel 20. In general, exhaust collector 140 has a width no less than the width of the access opening 40, and it forms an air collection zone above access opening 40 at the interior side of door panel 20. In the embodiment shown, back section 144 includes a side section 146 and a bottom section 148, thereby forming a chamber-like air collection zone. Other suitable structures can also be used for the exhaust collector. Exhaust blower 132 is connected between the top section 142 of exhaust collector 140 and exhaust duct 134 for providing a controlled venting through exhaust collector 140. Exhaust blower 132 can also be a 96 CFM blower.

As shown in FIGS. 3 and 4, the air curtain door system 10 of the present invention can be used with cooking oven 2 by installed the air curtain door system at the front portion 3 of the cooking oven 2. Suitable examples of cooking ovens are described in U.S. Pat. Nos. 6,146,677 and 6,250,210 B1, which are herein incorporated by reference in their entirety. It should be understood that the air curtain door system of the present invention can also be used with other ovens or heating devices which have an access opening for frequently providing food or other items into and retrieving the items from the ovens or heating devices.

Figure 5:
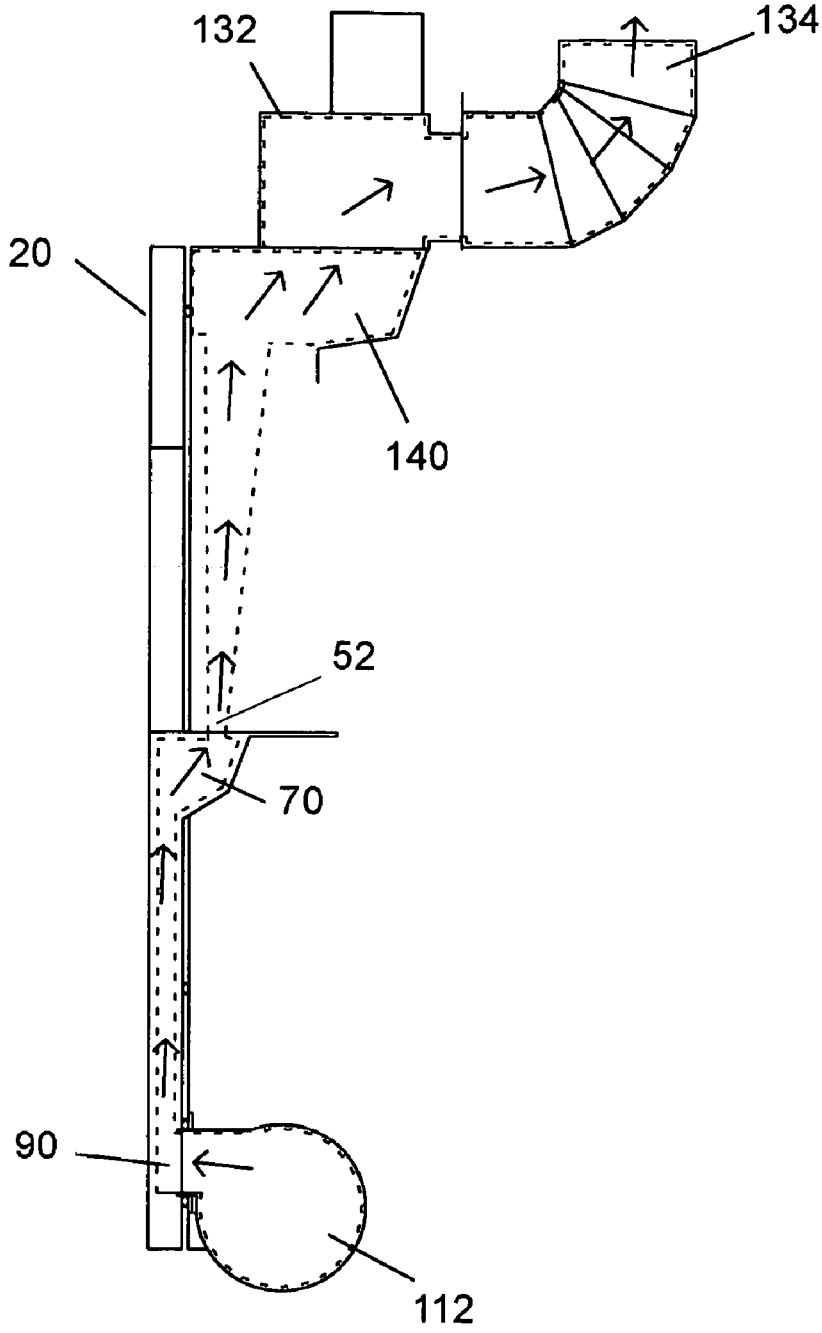
FIG. 5 is a schematic side view illustrating the air flow of the air curtain door system.

Now referring to FIGS. 2, 3 and 5, when in use, door panel 20 is in a closed position against front portion 3 of cooking oven 2 and air supply outlet 114 is pressed against air inlet opening 90. The interior of cooking oven 2 is maintained at a high temperature for cooking by heating means 4 and 160. Access opening 40 of door panel 20 provides a physical access to the user for putting the food on a food support panel 5 inside cooking oven 2 and retrieving it after cooking. The temperature inside cooking oven 2 can be constantly above 400° F., and typically maintaining at about 600° F. As shown in FIG. 5, air blower 112 blows air from outside of cooking oven 2 into hollow chamber 60 through air inlet opening 90 (air flow is shown by the arrows). The air flow spreads along side walls 68 and 68' as it moves up in hollow chamber 60, and exits through air outlet slot 52 of mantle 50. As the air flow exits air outlet slot 52, it forms an up moving air curtain at the interior side of access opening 40 and across the entire width of access opening 40. Exhaust blower 132 provides a suction along the top of the interior side of door panel 20, which guides the air flow into exhaust collector 40 and then exits from exhaust duct 134 to an exhaust outlet, such as the outside of a building or other exhaust venting exist. Using 96 CFM blowers as the air blower and the exhaust blower, the air flow speed of the air curtain can be in a range from about 200 to 500 feet per minutes. The air curtain forms an isolation layer behind access opening 40 between the interior and the exterior of cooking oven 2, which inhibits the heat and exhaust inside cooking oven 2 from exiting from access opening 40.

Figure 6:
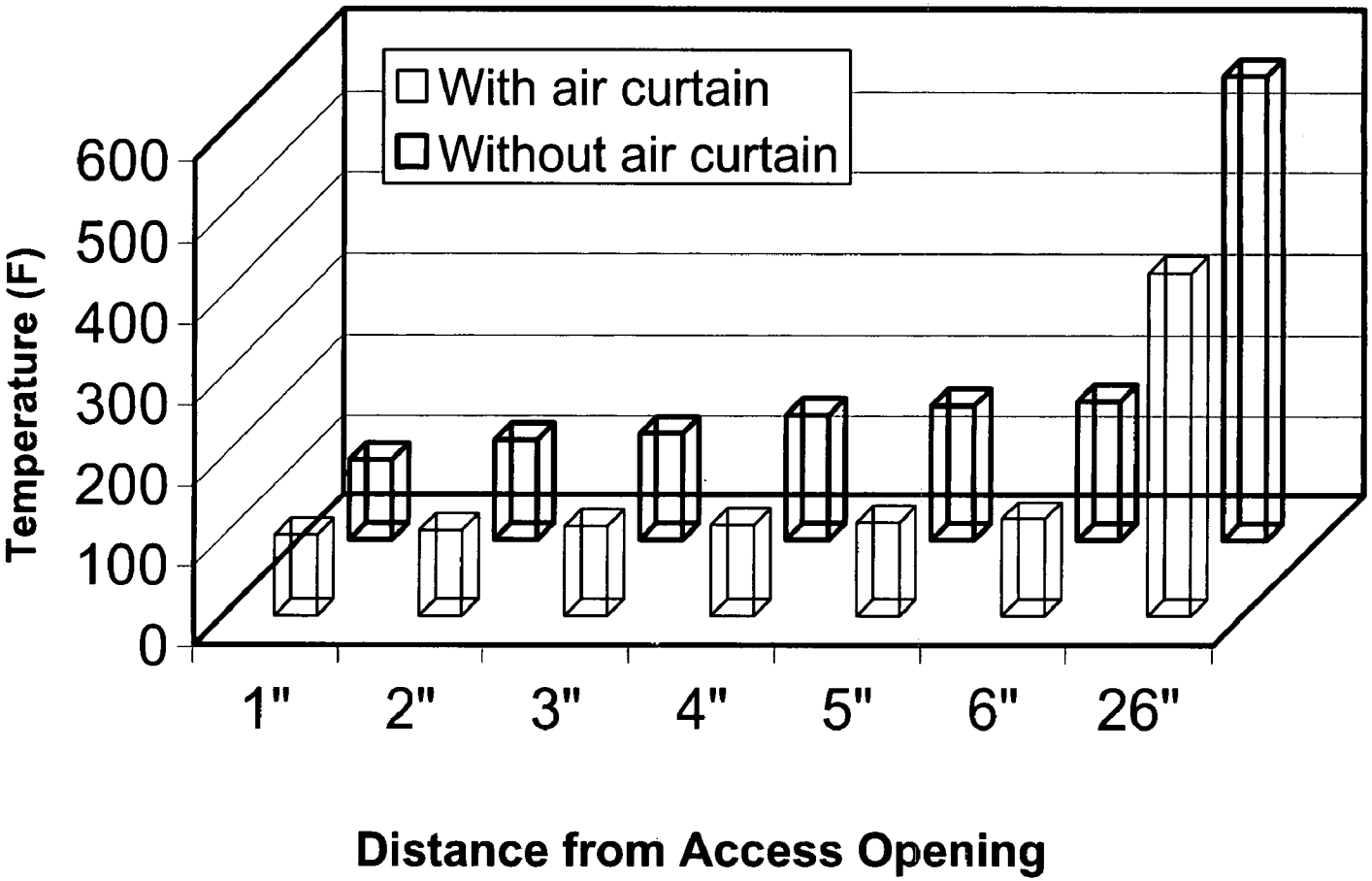
FIG. 6 is a bar graph illustrating heat isolation effect of the air curtain door system of the present invention.
Figure 7:
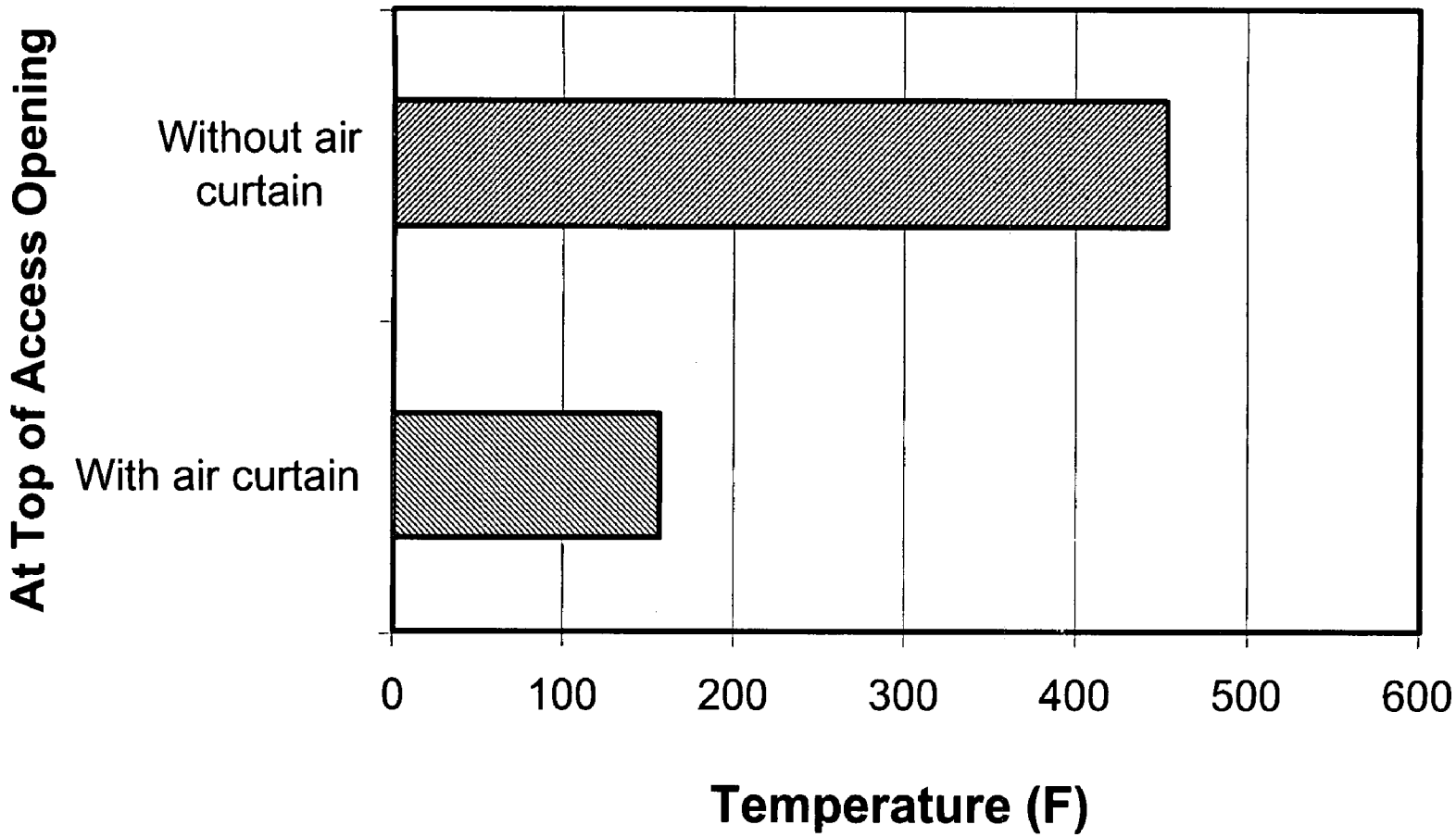
FIG. 7 is another bar graph illustrating temperatures at the top end of door opening in the presence and absence of the air curtain produced by the air curtain door system of the present invention.

FIG. 6 shows the thermal isolation effect achieved by the air curtain door system 10 of the present invention. The measurement was performed using a cooking oven as shown in FIG. 3, equipped with air curtain door system 10, in the presence and absence of the air curtain. For the case of absence of the air curtain, both air supply and exhaust blowers were off, and the entrance to exhaust blower 134 was blocked to prevent a spontaneous venting through exhaust collector 140. The temperatures from the exterior to the interior of the oven were measured with one inch interval, at the middle of a vertical axis of access opening 40, taking the first point at the position of exterior panel 22. The door panel 20 had a thickness of 1 inch. As shown, in a conventional operation mode without the air curtain, the temperature increased rapidly from access opening 40 to the adjacent interior, from about 120° F. to about 260° F. at a distance of about 7 inches from the first point. On the contrary, with the air curtain, the temperature at the first point was below 100° F., and it only increased a few degrees to slightly above 100° F. at a distance of about 7 inches from the first point, which was about 150° F. lower than the temperature at the same distance in the absence of the air curtain. As shown, beyond the air curtain, the interior temperature of the oven was about 575° F. (at 26 inches from the first point). In FIG. 7, when measuring at top end 44 of access opening 40, the temperatures were drastically different between in the presence of and in the absence of the air curtain. In the presence of the air curtain, the temperature was about 175° F., and in the absence of the air curtain the temperature was about 475° F. This example has illustrated an effective thermal isolation produced by the air curtain door system of the present invention.

In a further embodiment, the present invention provides an oven which incorporates the air curtain door system described above. FIG. 3 shows a high efficiency cooking oven 2 which comprises a housing 1, a high thermal storage capacity food support panel 5, heating means 4 for heating the food support panel 5, an infrared heating module 160 to deliver heat to a surface of the food support panel 5, fuel gas inlets 190 and 191 for supplying fuel gas to heating means 4 and infrared heating module 160, and an air curtain door system 10 as described above.

The housing 1, a high thermal storage capacity food support panel 5, and heating means 4 for heating the food support panel 5 have been fully described in U.S. Pat. Nos. 6,146,677 and 6,250,210 B1, which are herein incorporated by reference in their entirety. As shown in FIG. 3, the infrared heating module 160 is positioned at the rear top portion of cooking oven 2. The infrared heating module 160 includes an infrared emitter 170 and a blower 180. The infrared emitter 170 is oriented toward an area of food support panel 5 for providing a region of intensified cooking. The blower 180 blows fresh air into an orifice (not shown) of infrared emitter 170, and promotes mixing between air and fuel gas, which results in a complete combustion of the fuel gas. Using the infrared heating module 160, the efficiency of the fuel gas is improved, and the waste material from the combustion is reduced. Therefore, from this aspect, the cooking oven of the present invention is also energy saving, and environmentally more compatible.

It is noted that the term "oven" used herein denotes a closed heating chamber or heating device with an access opening. The access opening can be a permanent opening without a cover as that shown in FIG. 1, however, can also be an opening with a cover such as a door. Although the utility of the air curtain door system of the present invention is illustrated using the cooking oven shown in FIG. 3, it should be understood that the air curtain door system can also be used for an oven or a heating device which has a door covering the front opening. The air curtain door system can be installed behind of the door of an oven or a heating device. When the door is opened, the air curtain door system can prevent releasing heat, smoke or other exhaust waste from the oven. In this situation, the opening of the air curtain door system can be configured to meet the specific structural requirements of the ovens or heating devices.

The air curtain door system and the oven incorporating the air curtain door system of the present invention have several advantages. Using the instant air curtain door system, the environment temperature in front of the oven is not elevated by the heat released through access opening 40. This provides a comfortable working area immediate outside the opening for the workers and also results in saving of the energy required for environment cooling in the surrounding area. The air curtain door system provides a controlled heat and smoke venting to the outside of the building or other exhaust venting assembly, therefore, it reduces air pollution in the surrounding area of the oven. In fact, the cooking oven equipped with the air curtain door system of the present invention has obtained the permit from Applied Research Laboratory licensed by OSHA, (Miami, Fla.), for use inside restaurants in the United States without requiring installation of a hood at the front of the oven for venting.

We claim:

1. An air curtain door system for an oven comprising:

(a) a door panel having an interior panel and an exterior panel, said door panel including:

an access opening at an upper portion thereof;

a mantle attached to a bottom end of said access opening, said mantle extending horizontally along a width of said access opening and extending toward an interior side of said door panel beyond said interior panel; said mantle having an air outlet slot positioned at said interior side of, and adjacent to, said door panel, said air outlet slot extending horizontally along said access opening;

an air inlet opening on said interior panel near a lower end of said door panel;

a hollow chamber between said interior and exterior panels disposed from said mantle to near said lower end of said door panel; a bottom portion of said hollow chamber connecting to said air inlet opening; and a top portion of said hollow chamber having an air outlet section underneath said mantle; and said air outlet section being formed by extruding of a top portion of said interior panel toward said interior side of said door panel and connecting to a bottom side of said mantle at an interior side of said air outlet slot, and said air outlet section extending horizontally along said mantle; thereby said air outlet slot being an outlet of said hollow chamber;

(b) an air supply means located near said lower end of said door panel, and interfacing with said air inlet opening for providing air supply to said hollow chamber through said air inlet opening; and (c) an exhaust venting assembly located at said interior side of, and adjacent to an upper end of, said door panel, for pulling air exiting from said air outlet slot of said mantle into said exhaust venting assembly, thereby forming an air curtain covering said access opening at said interior side of said door panel.

2. The air curtain door system of claim 1, wherein said air supply means is an air blower providing air supply through an air supply outlet into said air inlet opening of said door panel.

3. The air curtain door system of claim 2, wherein said air supply outlet has a structure complementary to said air inlet opening of said door panel and forms an air seal at an interface between said air supply outlet and said air inlet opening.

4. The air curtain door system of claim 1, wherein said exhaust venting assembly comprises an exhaust collector, an exhaust blower connected to said exhaust collector and an exhaust duct connecting said exhaust blower to an exhaust outlet.

5. The air curtain door system of claim 4, wherein said exhaust collector has closed top and back sections and an open section downwardly facing said air outlet slot of said mantle, and said exhaust collector has a width no less than said width of said access opening; wherein said exhaust collector extends horizontally along said upper end of said door panel and forms an air collection zone at said interior side of said door panel.

6. The air curtain door system of claim 1, wherein said hollow chamber has two opposing side walls extending outwardly from said bottom portion in an upward direction, and has a width at an upper end thereof substantially equivalent to a length of said air outlet slot.

7. The air curtain door system of claim 1, wherein said air outlet slot of said mantle extends near an entire width of said mantle.

8. The air curtain door system of claim 7, wherein said air outlet slot has a width in a range from about 0.25 inch to about 1 inch.

9. An oven having an air curtain door system, comprising:

(a) a heating chamber having a top, a bottom and two side walls and a front opening, said heating chamber equipped with at least one heating element; and (b) said air curtain door system, comprising:

(i) a door panel having an exterior panel and an interior panel interfacing with front portions of said walls of said heating chamber, said door panel including:

an access opening at an upper portion thereof;

a mantle attached to a bottom end of said access opening, said mantle extending horizontally along a width of said access opening and extending toward an interior side of said door panel beyond said interior panel; said mantle having an air outlet slot positioned at said interior side of, and adjacent to, said door panel, said air outlet slot extending horizontally along said access opening;

an air inlet opening on said interior panel near a lower end of said door panel;

a hollow chamber between said interior and exterior panels disposed from said mantle to near said lower end of said door panel; a bottom portion of said hollow chamber connecting to said air inlet opening; and a top portion of said hollow chamber having an air outlet section underneath said mantle; and said air outlet section being formed by extruding of a top portion of said interior panel toward said interior side of said door panel and connecting to a bottom side of said mantle at an interior side of said air outlet slot, and said air outlet section extending horizontally along said mantle; thereby said air outlet slot being an outlet of said hollow chamber;

(ii) an air supply means located near said lower end of said door panel, and interfacing with said air inlet opening for providing air supply to said hollow chamber through said air inlet opening; and (iii) an exhaust venting assembly located at said interior side of, and adjacent to an upper end of, said door panel, for pulling air exiting from said air outlet slot of said mantle into said exhaust venting assembly, thereby forming an air curtain covering said access opening at said interior side of said door panel.

10. The oven of claim 9, wherein said exhaust venting assembly comprises an exhaust collector, an exhaust blower connected to said exhaust collector and an exhaust duct connecting said exhaust blower to an exhaust outlet.

11. The oven of claim 10, wherein said exhaust collector has closed top and back sections and an open section downwardly facing said air outlet slot of said mantle, and said exhaust collector has a width no less than said width of said access opening; wherein said exhaust collector extends horizontally along said upper end of said door panel and forms an air collection zone at said interior side of said door panel.

12. The oven of claim 9, wherein said hollow chamber has two opposing side walls extending outwardly from said bottom portion in an upward direction, and has a width at an upper end thereof substantially equivalent to a length of said air outlet slot.

13. The oven of claim 9, wherein said air outlet slot of said mantle extends near an entire width of said mantle.

14. A method of inhibiting heat and exhaust in an oven from exiting from an access opening thereof, comprising the steps of:

(a) installing a door panel to said oven, said oven having a heating chamber including a top, a bottom and two side walls and a front opening, said heating chamber equipped with at least one heating element; said door panel having an exterior panel and an interior panel interfacing with front portions of said walls of said heating chamber, said door panel including:

said access opening at an upper portion thereof;

a mantle attached to a bottom end of said access opening, said mantle extending horizontally along a width of said access opening and extending toward an interior side of said door panel beyond said interior panel; said mantle having an air outlet slot positioned at said interior side of, and adjacent to, said door panel, said air outlet slot extending horizontally along said access opening;

an air inlet opening on said interior panel near a lower end of said door panel;

a hollow chamber between said interior and exterior panels disposed from said mantle to near said lower end of said door panel; a bottom portion of said hollow chamber connecting to said air inlet opening; and a top portion of said hollow chamber having an air outlet section underneath said mantle; and said air outlet section being formed by extruding of a top portion of said interior panel toward said interior side of said door panel and connecting to a bottom side of said mantle at an interior side of said air outlet slot, and said air outlet section extending horizontally along said mantle; thereby said air outlet slot being an outlet of said hollow chamber;

(b) providing an air supply means near said lower end of said door panel, and interfacing said air supply means with said air inlet opening to provide air supply into said hollow chamber; and (c) providing an exhaust venting assembly at said interior side of said door panel, adjacent to an upper end of said door panel, wherein said exhaust venting assembly pulls air exiting from said air outlet slot of said mantle into said exhaust venting assembly, and forms an air curtain covering said access opening at said interior side of said door panel;

wherein said air curtain inhibits heat and exhaust inside said heating chamber from exiting from said access opening.

15. The method of claim 14, wherein said exhaust venting assembly comprises an exhaust collector, an exhaust blower connected to said exhaust collector and an exhaust duct connecting said exhaust blower to an exhaust outlet; said exhaust collector has closed top and back sections and an open section downwardly facing said air outlet slot of said mantle, and said exhaust collector has a width no less than said width of said access opening; wherein said exhaust collector extends horizontally along said upper end of said door panel and forms an air collection zone at said interior side of said door panel.

16. The method of claim 14, wherein said hollow chamber has two opposing side walls extending outwardly from said bottom portion in an upward direction, and has a width at an upper end thereof substantially equivalent to a length of said air outlet slot; wherein air blew into said hollow chamber expands outwardly while moving up and exists said air outlet slot with a width substantially covering said width of said access opening.

* * * * *